United States Patent [19]

Burns

[11] 4,416,369

[45] Nov. 22, 1983

[54] DISPLAY AND DISPENSING CARTON

[75] Inventor: Edward P. Burns, Cos Cob, Conn.

[73] Assignee: Nabisco Brands, Inc., Parsippany, N.J.

[21] Appl. No.: 338,681

[22] Filed: Jan. 11, 1982

[51] Int. Cl.[3] ..... B65D 5/64

[52] U.S. Cl. ..... 206/45.29; 206/45.28; 220/18; 229/33; 229/44 R

[58] Field of Search ..... 206/44, 45.13, 45.18, 206/45.19, 45.2, 45.21, 45.23, 45.28, 45.29, 45.3, 301; 229/33, 36, 44 R; 220/18

[56] References Cited

U.S. PATENT DOCUMENTS

| | | | |
|---|---|---|---|
| D. 118,010 | 12/1939 | Broderick | 206/45.29 |
| 1,609,186 | 11/1926 | Peruzzi | 206/45.29 |
| 1,871,706 | 8/1932 | Krebs | 206/45.29 |
| 2,148,533 | 2/1939 | Chapman | 206/45.29 |
| 2,319,919 | 5/1943 | Clark | 206/45.3 |
| 4,201,291 | 5/1980 | Davidson | 206/45.29 |

FOREIGN PATENT DOCUMENTS

| | | | |
|---|---|---|---|
| 417642 | 10/1934 | United Kingdom | 206/45.29 |
| 1161172 | 8/1969 | United Kingdom | 206/45.28 |

*Primary Examiner*—George E. Lowrance
*Assistant Examiner*—Jimmy G. Foster
*Attorney, Agent, or Firm*—Richard Kornutik

[57] ABSTRACT

A display and dispensing carton which includes front and rear walls, top and bottom walls and a pair of side walls articulated to form a rectangular enclosure including a rear wall constituted of separate plies to form a tear-resistant laminated wall structure. Openings are provided in the rear edge portion of the bottom wall and in the rear wall for receiving a bracket to support the carton at the point of sale. The top wall of the carton incorporates a tear line to facilitate the removal of at least some of the top wall and front wall to provide display for the goods contained in the carton.

9 Claims, 4 Drawing Figures

DISPLAY AND DISPENSING CARTON

BACKGROUND OF THE INVENTION

1. Field of the Invention

The present invention relates to a display and dispensing carton and, more particularly, relates to a carton structure which is adapted to be used for purposes of display of merchandise contained therein at the point of sale.

In view of continually increasing material handling and packaging costs, it has become common practice to have a carton or shipping container perform the dual functions of providing a container for the packaging and shipping of articles from a manufacturer to a merchandiser or retailer, and with the carton also being adapted for use as a display arrangement in the merchandising or retailing establishment. Generally, such dual-purpose dispensing and display cartons incorporate features in which at least a portion of the upper carton section or top panel and, if desired, a part of the front panel, may be detached from the carton so as to afford access to the articles stored within the carton without destroying the integrity of the carton, and thereby permitting the carton to remain intact as a dispensing and display carton arrangement. In order to facilitate the utilization of a carton of this type in that manner, the carton is usually suspended on brackets which are fastened to the edges of display shelves, wherein the brackets include upstanding finger portions which engage interiorly of the rear wall panel structure through openings formed in the rear panel wall and bottom wall panel of the carton.

Moreover, the carton may include, as an integral part of the rear wall panel, a rear flap adapted to project above the rear panel structure and on which there may be provided suitable indicia, pricing information or advertising legends concerning the merchandise or articles contained in the carton which renders it easier for a consumer to select this merchandise in the retail establishment.

An important aspect in the mounting of dispensing and display cartons of this type has been the need to provide for the secure suspension of the carton in the bracket structure without the carton distorting or sagging in an unsightly manner under the weight of the articles contained therein. Concurrently, the container and, particularly, the upwardly projecting advertising flap on the rear wall panel structure must be designed so as not to obscure the consumers view of or block access to other cartons or merchandise being retailed which are displayed behind the suspended carton.

2. Discussion of the Prior Art

A carton structure of this type which incorporates the dual function of a shipping container when closed and that of a dispensing and display carton when in an opened condition is disclosed in Davidson U.S. Pat. No. 4,201,291. Thus, Davidson discloses a display and dispensing carton wherein the rear wall panel structure consists of three laminated plies and includes a plurality of openings adapted to be engaged by upstanding bracket members for supporting the carton along the edge of a shelf or the like on which there may be supported other merchandise or cartons. One ply of the rear wall panel structure extends into flap member which is normally folded inwardly of the carton when the latter is in a closed condition and, when the carton is opened for display purposes, is adapted to be bent outwardly of the carton so as to form a coplanar upward extension of the rear wall panel structure to thereby provide an advertising or sales display above the carton. In order to convert the originally closed carton into a display device, the major portion of the top wall panel and a part of the front wall panel includes an encompassing tear line along which those carton portions may be detached from the carton so as to allow for access to the articles or merchandise stored therein and to permit the rear wall flap member to be bent upwardly for display. Although this provides a generally satisfactory display and dispensing carton arrangement, it necessitates that the rear wall panel structure be formed of three plies of which one includes the flap member which must be normally folded inwardly of the carton prior to the opening of the latter. Moreover, in order to provide access to the articles or merchandise contained within the carton, the major portion of the top wall panel and at least a portion of the front wall panel must be completely detached by tearing and removing along the tear line which is provided for this purpose.

SUMMARY OF THE INVENTION

Accordingly, the present invention has as its primary object the provision of an improved dispensing and display carton of the above type which is adapted to remain suspended from a bracket arrangement for lengthy periods of time at the point of sale in a retail merchandising establishment.

A further object of the present invention resides in the provision of a carton of the type described which does not require the complete detachment of the top wall panel portion and part of the front wall panel portion in order to allow a consumer access to the articles stored in the carton.

A still further object of the present invention resides in the provision of a carton of the type described which allows for the folding back of the opened top wall panel and front wall panel along predetermined crease lines formed therein upon opening of the carton along a tear line and the folding together thereof behind the carton-supporting bracket so as to form a novel carton display arrangement.

Another object of the present invention is to provide a dispensing and display carton of the above mentioned type which is adapted to be supported while suspended on a bracket structure and which can support relatively heavy articles therein without sagging or loosing its shape.

Yet another object of the invention is to provide a blank for a carton which is imbued with the above-mentioned features and characteristics.

Basically, the carton pursuant to the invention has a generally rectangular configuration and includes a top wall, and bottom wall, a front wall, a rear wall and a pair of side walls. The rear wall of the carton is constructed of two separate plies of material which are glued together so as to render the wall substantially rigid and tear resistant.

Tear lines are formed in the sides of the top wall and extend down and across at least a part of the front wall to permit portions of the top and front walls to be lifted up from the carton and pivoted about a crease line formed along the transverse forming the juncture between the rear wall and the top wall of the carton so as to expose the contents of the carton.

A plurality of die cut slots are formed in the bottom wall proximate or contiguous to the juncture thereof with the rear wall at suitable spaced-apart locations. Similarly, superimposed die cut slots and die cut squares are formed in the rear wall panel structure. These openings are adapted to receive the upstanding finger portions of brackets secured to a shelf or other support, and which engage the inner surface of the rear wall of the carton so as to securely suspend the carton and to thereby render the carton contents clearly visible to a prospective purchaser.

A transversely extending crease line is formed in the top wall at generally the center thereof, or in essence, approximately half-way between the front and rear edge of the top wall. Thereby, upon opening of the carton along the tear line, the top wall may be folded together along the centrally located crease line, and the front wall portion still attached thereto tucked down behind the bracket fingers. This will cause the top wall to assume a two-ply vertical configuration which is generally coplanar with the rear wall and projecting upwardly thereabove.

The carton is distinguished by its inexpensive and simple construction in that it is constructed from a unitary blank of material employing a single glueing operation and three folding operations, and is adapted to be transported in a flat, knocked-down condition. The blank may be formed into the carton by opening thereof into its rectangular shape and then glueing the end flaps which form the carton end walls in the usual manner well known in the art.

BRIEF DESCRIPTION OF THE DRAWINGS

Reference may now be had to the following detailed description of a preferred embodiment of a dispensing and display carton pursuant to the invention, taken in conjunction with the accompanying drawings; in which.

DETAILED DESCRIPTION

Figure 1:
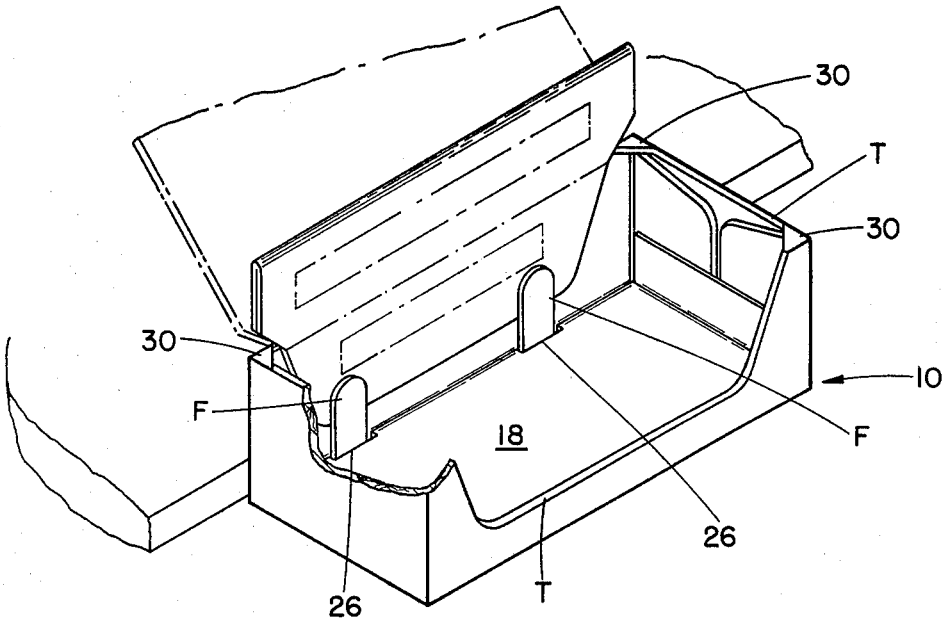
FIG. 1 is a perspective view of a carton pursuant to the invention shown supported and in position for displaying and dispensing its contents.
Figure 2:
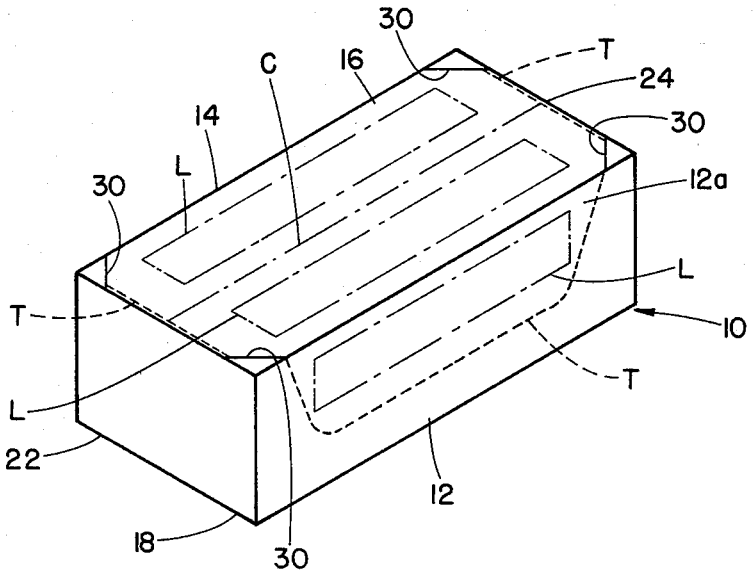
FIG. 2 is a perspective view of the carton in its closed condition.

Referring now in particular to FIGS. 1 and 2 of the drawings, the display and dispensing carton 10 consists of panels which includes a front wall 12 with a rear wall 14 and top wall 16, a bottom wall 18 and a pair of side or end walls 22 and 24. The carton is shipped to a retailer or merchandiser in the closed condition as shown in FIG. 2, having been previously filled with suitable contents destined for sale in the retail establishment. The carton 10 is adapted to be suspended from a shelf or other support by means of a rigid bracket having upstanding fingers F. These fingers F of the bracket are adapted to project interiorly of the carton along the inner surface of the rear wall thereof, as explained further or hereinbelow, through apertures **26*a* formed through die cut slots in the bottom wall 18 of the carton at the juncture thereof with the lower edge of the rear wall 14. The apertures 26*b* are spaced along the bottom wall of the carton in conformance with the dimensions of the brackets which are to be utilized for the support of the carton 10. Similarly, for the same purpose, other apertures 26*a* formed through die cut slots and apertures 26*c* formed through die cut squares are provided in the rear wall 14** located somewhat centrally along the height thereof. This will permit the carton to be suspended on brackets which enter through the rear wall of the carton rather than the bottom wall.

A tear line T is formed in the carton 10 so as to extend along the side edges of the carton of the top wall 16 except for the corners thereof and down and across a portion of the carton front wall 12. The tear line T allows the therewith encompassed portion **12*a* of the front wall and the top wall 16 to be separated therealong and to be pivoted or swung upwardly at the fold line along the rear edge of the top wall 16 and the upper edge of the rear wall 14, thereby allowing for opening the carton as shown in FIG. 1** of the drawings.

Figure 3:
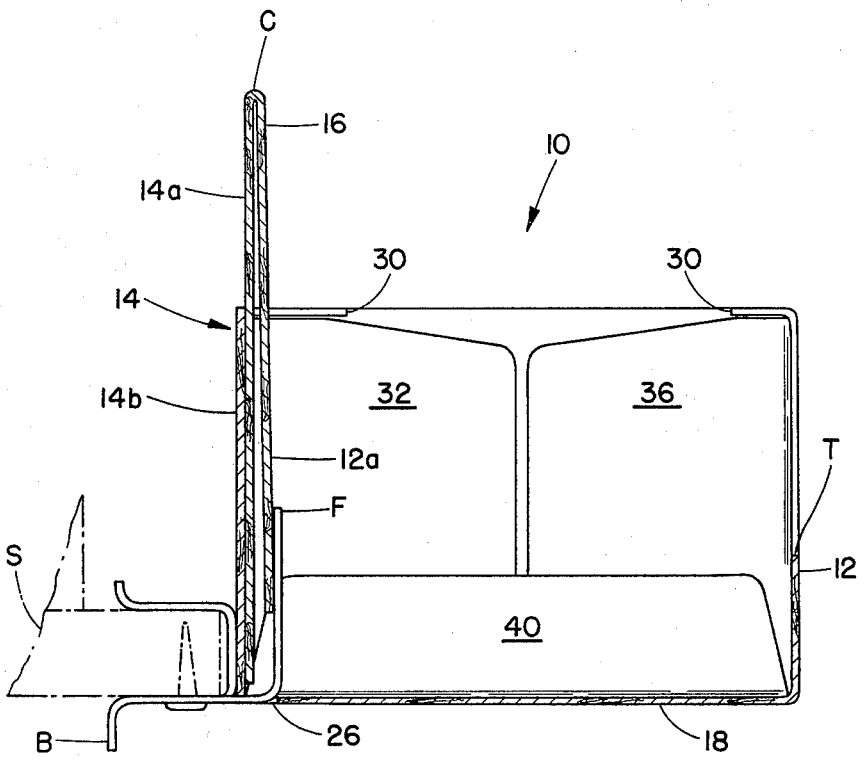
FIG. 3 is an enlarged sectional view taken along line 3—3 in FIG. 1.

Upon opening of the carton along the tear line T, the top wall 16 is adapted to be folded upwardly back upon itself along the crease line C extending transversely at approximately the center thereof, and with the portion **12*a* of the front wall 12 adapted to be slid down behind the upstanding fingers F of the bracket so as to lie flat against the inner surface of the upstanding flattened-together top wall 16 and rear wall 14, as shown more clearly in FIG. 3 of the drawings. Suitable advertising and display legends L may be imprinted or embossed on the top wall 16 and on the front wall portion 12*a* tucked behind the bracket fingers F, the legends L printed on the forward portion of the top wall 16** will be in a vertical plane facing forwardly and readily visible to a prospective customer.

As may be clearly ascertained from FIGS. 1 and 2, the tear line T permits the corners of the top wall 16 to remain intact subsequent to the opening of the carton, thereby forming substantially triangular webs 30 at the four corners which will act as reinforcements and assist in maintaining the configuration or integrity of the carton 10 when the latter is suspended on the bracket fingers F or when subjected to an unbalanced load in the carton.

As may be ascertained from FIGS. 3 of the drawings, the rear wall 14 of the carton 10 is constituted of two glued-together plies **14*a* and 14*b*, thereby forming a lamintated structure which renders the rear wall 14 substantially more rigid and resistant to tearing, and enabling the carton 10 to be safely supported on the bracket fingers F. As shown in FIG. 3**, the bracket fingers F are a portion of a bracket B which is adapted to be fastened, through suitable fasteners such as a screw or the like, to a shelf S.

Figure 4:
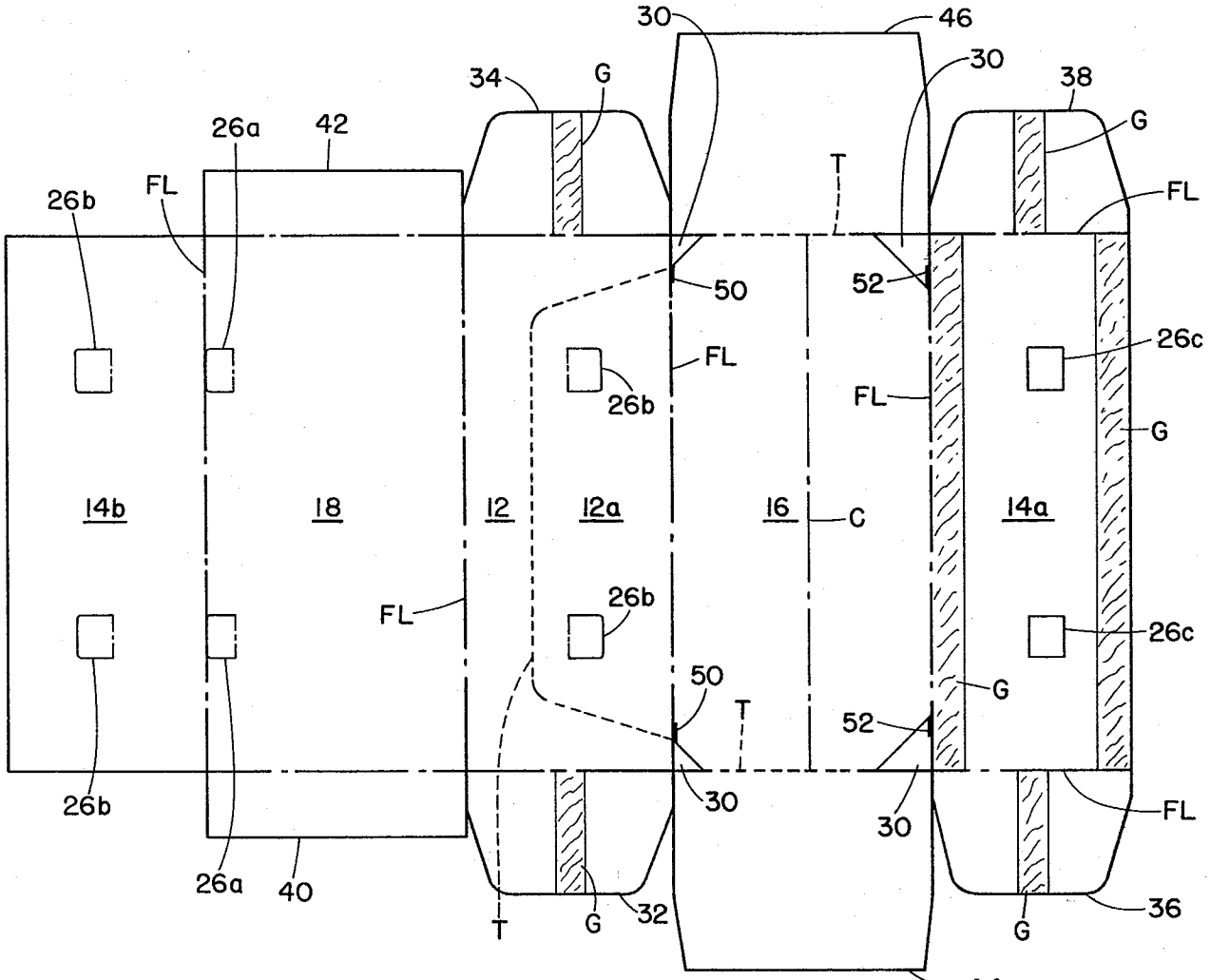
FIG. 4 is a top plan view of the blank from which the carton is formed.

As shown in FIG. 4 of the drawings, the carton 10 is constituted of a single piece of board material having the tear line T formed therein by means of either perforations or serrations. The rear wall 14 is formed by the inner ply **14*a* and an outer ply 14*b* adapted to be glued thereto along at least one glue line G, although if desired, glue lines may be provided along both longitudinal edges of the rear wall ply 14*a***. A number of fold lines FL are shown extending along the edges of the various carton wall panels, as is well known in the carton art, thereby permitting the folding of the blank into a carton along the various fold lines.

Front wall 12 is provided with end flaps 32 and 34 adapted to be folded within end flaps 36 and 38 on the rear wall ply **14*a*, and are braced in position by the end flaps 40 and 42 on the bottom wall 18 which are folded down and glued to end flaps 32, 34, 36 and 38. Suitable glueing material may be provided on the surfaces of end flaps 32, 34, 36 and 38, as shown in FIG. 4, for adhesion to flaps 44 and 46** so as to thereby form a closed carton construction.

At the corners 30 formed at the fold line between panels 12*a* and 16 there are formed short die cut slits 50 extending inwardly along the fold line. Similar slits 52 are provided along the fold line between panels 16 and 14*a*, the diagonel corners 30 here being somewhat larger than the diagonel corners between panels 12*a* and 16. Consequently, upon the panel 16 being folded, inserted behind the bracket fingers and pushed back against the rear wall 14, the slit 50 and 52 will interlock and provide a further locking feature.

As may be ascertained from the foregoing, the invention sets forth an extremely simple and novel carton structure which is of an extremely rigid construction and which presents the versatility of being concurrently a shipping carton from the wholesaler or packaging location to a retailer, and at the point of sale in the retail establishment forming a display and dispensing carton by the simple expedient of opening and lifting up the top wall panel structure and a portion of the front wall panel structure, folding these together along the crease line C, and tucking the front wall panel portion behind the upstanding fingers F of the bracket arrangement which suspends or supports the carton from a shelf or suitable support.

What is claimed is:

1. A combination shipping and display carton having a first carton blank configuration, a second shipping configuration and a third display configuration, said carton comprising:

(a) in said first configuration a single unitary blank, said blank having:

(i) first and second rear wall panels formed as the opposite ends of the unitary blank, with at least one adhesive means formed on at least one of the rear wall panels, (ii) a front wall panel having a bottom panel and a top panel on opposite sides thereof, said front, top and bottom panels joining said first and second rear wall panels, (iii) a plurality of first and second end panels attached to at least one of the rear, front, top and bottom wall panels with a second adhesive means formed on at least one of each of said first and second end panels, (iv) said blank being formed with a tear line parallel to the end panels across the top panel and extending across the front panel to traverse the panel from said frist end to said second end, said top panel having a transverse crease line formed therein, (v) one side of said blank providing space for printed advertising matter to be used in said second and third configurations, (b) in said second configuration, a closed shipping carton, said carton having;

(i) said first and second rear wall panels joined together by said first adhesive means to define a rectangular enclosure with said space for said printed advertising matter on the outside thereof, (ii) said end panels being secured together by the second adhesive means to form a closed shipping carton, (c) in said third display configuration, said carton having:

(i) said front and top panels being severed along said tear line, (ii) said top panel being folded along said crease line, (iii) said front panel and said top panel being adjacent to and reinforcing said rear wall panel, said upstanding front and top folded configuration providing a display panel for said printed advertising matter.

2. A carton as claimed in claim 1 wherein at least one bracket-receiving opening is formed at the juncture between said bottom wall panel and said rear wall panel.

3. A carton as claimed in claim 2, which further comprises a pair of bracket-receiving openings spaced along said bottom wall panel.

4. A carton as claimed in claim 2, wherein said bracket-receiving opening further comprises at least one die cut slot formed in said bottom wall panel.

5. A carton as claimed in claim 1 wherein at least one bracket-receiving opening is formed in the rear wall panels intermediate the top and bottom wall panels.

6. A carton as claimed in claim 5, wherein said bracket-receiving opening is formed of superimposed die cut slots and die cut squares cut into the rear wall structure of said rear wall panels.

7. A carton as claimed in claim 1 wherein said tear line will define corners on said top panel to form reinforcing structures interconnecting the adjoining wall panel structure when the shipping carton configuration is opened along said tear line.

8. A carton as claimed in claim 8, comprising slits formed along portions of said tear line adjacent said corners on the opposite sides of said top wall panel, said slits being interengageable upon folding up of the top panel so as to form a locking structure.

9. A carton as claimed in claim 3, wherein said tear line extends along a portion of the carton front wall panel wherein said portion may be lifted out of the carton and folded down between the inner surface of the rear wall structure and a pair of upstanding brackets extending through said openings in said rear wall panels.

* * * * *